US006624136B2

(12) United States Patent
Guerin et al.

(10) Patent No.: US 6,624,136 B2
(45) Date of Patent: Sep. 23, 2003

(54) WATER-DISPERSIBLE GRANULES COMPRISING A FRAGRANCE IN A WATER-SOLUBLE OR WATER-DISPERSIBLE MATRIX, AND PROCESS FOR THEIR PREPARATION

(75) Inventors: Giles Guerin, Eaubonne (FR); Mikel Morvan, Asnieres (FR); Daniel Joubert, Vineuil-Saint Firmin (FR)

(73) Assignee: Rhodia Chimie, Boulogne Billancourt Cedex (FR)

( * ) Notice: Subject to any disclaimer, the term of this patent is extended or adjusted under 35 U.S.C. 154(b) by 0 days.

(21) Appl. No.: 10/310,595

(22) Filed: Dec. 5, 2002

(65) Prior Publication Data

US 2003/0087788 A1 May 8, 2003

Related U.S. Application Data

(63) Continuation of application No. 09/600,696, filed as application No. PCT/FR99/00132 on Jan. 22, 1999, now abandoned.

(30) Foreign Application Priority Data

Feb. 2, 1998 (FR) ..... 98 01157

(51) Int. Cl.[7] ..... C11D 17/00
(52) U.S. Cl. ..... 510/438; 510/463
(58) Field of Search ..... 510/438, 463

(56) References Cited

U.S. PATENT DOCUMENTS 3,681,248 A * 8/1972 Gould et al. ..... 252/89
4,209,417 A * 6/1980 Whyte ..... 252/174.11
5,525,367 A * 6/1996 King et al. ..... 426/533
5,733,272 A * 3/1998 Brunner et al. ..... 604/359
6,258,297 B1 * 7/2001 Guerin et al. ..... 252/363.5

FOREIGN PATENT DOCUMENTS

| | | | |
|---|---|---|---|
| EP | 376385 | * | 7/1990 |
| EP | 385534 A1 | * | 9/1990 |
| EP | 397246 A2 | * | 11/1990 |
| WO | WO 94/19448 | * | 9/1994 |
| WO | WO 97/15385 | | 5/1997 |
| WO | WO 97/15386 | * | 5/1997 |
| WO | WO 97/15387 | * | 5/1997 |
| WO | WO 98/02518 | * | 1/1998 |

OTHER PUBLICATIONS

International Search Report of WO 99/3895 (PCT/FR 99/00132).

* cited by examiner

*Primary Examiner*—John Hardee

(57) ABSTRACT

The invention concerns water dispersible granulates comprising: at least a hydrophobic perfume (P), in the form of droplets, finely divided in and encapsulated by a water soluble or water dispersible solid organic matrix (MO) selected among: polypeptides (PP) of plant or synthetic origin; polyelectrolytes (PE) belonging to the family of weak polyacids; or their mixtures; and at least an emulsifying agent (AE) at the droplet/matrix interface. The invention also concerns a method, in two steps, for preparing said granulates, the first step consisting in preparing an emulsion in water comprising at least a hydrophobic perfume (P), at least an emulsifying agent (AE); and said water soluble or water dispersible organic matrix (MO), the second step consisting in drying said emulsion until a granulate is formed.

20 Claims, No Drawings

WATER-DISPERSIBLE GRANULES COMPRISING A FRAGRANCE IN A WATER-SOLUBLE OR WATER-DISPERSIBLE MATRIX, AND PROCESS FOR THEIR PREPARATION

This application is a continuation of U.S. application Ser. No. 09/600,696, filed on Sep. 11, 2000, which is a 371 of PCT/FR99/00132, filed Jan. 22, 1999.

The present invention relates to water-dispersible granules comprising at least one fragrance in a water-soluble or water-dispersible organic polymer matrix, to a process for preparing them, to their use as fragrancing agents in detergent or cosmetic compositions and to laundry detergent compositions or cosmetic compositions comprising said particles.

The fragrancing of detergent washing compositions, in particular for washing laundry, requires a certain number of constraints that are more or less important depending on the technico-economic and marketing objectives of the formulator.

One of the first problems posed is to find a suitable means of adding and distributing the liquid fragrance on the detergent powder.

The fragrance is generally finely sprayed, continuously, onto the complete formulated powder, which transits in any transporter, between the site of manufacture and the site of packaging. Pneumatic transporters can be used for this operation, or alternatively "air lift" systems. It is necessary for the washing product formulated to be sufficiently cooled, in particular when the manufacturing process is a spraying process, and for the mixing system to permit only a minimal loss of fragranced substance, which is among the most expensive components of the formulation. Respecting the dosage (percentage of fragrance relative to the powder) is one of the factors that is difficult to control and which needs investigating to be improved both on account of the problems of cost and on account of the problems of consistency of quality.

Formulating the composition as a particulate solid can represent a first improvement to this level of process for manufacturing washing products.

Another problem of the fragrancing of washing products is that of the stability of the fragrance (and of all of the "notes" it releases) during storage of the washing product in its packaging.

Specifically, the components of washing products are themselves very varied and their chemical natures are very diverse and may be corrosive, or even incompatible, with the fragranced composition, which comprises chemically fragile components.

Modern washing products often contain bleaching systems based on products which release hydrogen peroxide, followed by active oxygen. This is the most destabilizing factor for the fragrances.

The alkalinity of the compositions is also a factor with regard to degradation of the fragrance.

Highly absorbent products such as silicas, clays or zeolites can selectively and to a greater or lesser extent absorb the fragrance or one of its components and thereby contribute toward modifying or impairing it.

Similarly, the water of crystallization, free water, surfactants and sequestering agents, which are always present in detergent compositions, may interfere negatively with the fragranced compositions.

A third problem, or a third requirement, encountered in the field of fragrancing washing products is the fact that the perception of the odor chosen, which is one of the methods by which the purchaser recognizes the washing product, should be effective in all the lifecycles of the washing product, and even beyond.

In particular, the odor of the fragrance, or at the very least a fraction of this odor, should be perceptible in the shop in which the washing product is presented for purchase, during the shelf life of the packet (even opened), during the washing itself, from the washing machine, during the operations of drying, ironing and tidying away of the washed articles, in the wardrobe, and finally during the wearing or use of the laundry.

Such a series of requirements is obviously not easy to satisfy, but among the means which need to be deployed to attend to this satisfaction, coating and encapsulation, which improve the stability on storage and can under certain conditions allow a release of the fragrance during washing, are one of the most important and most effective means.

Several methods for formulating fragrances in solid form have been attempted in the past or very recently by fragrance manufacturers or by washing product manufacturers to partially or totally solve these problems.

One of the first means is to use the absorbent properties of certain porous supports, such as silicas, clays, natural or synthetic zeolites, starches, carboxymethylcellulose, urea, soluble inorganic phosphates, etc.

However, there are numerous drawbacks with these formulation methods, in particular the fact of dividing and spreading the fragrance over very large contact surfaces, and thus of increasing the risks of oxidation at the same time as the area for exchange between the fragrance and the air, and also the risk of selectively retaining one or more components, with restitution of a modified odor.

Simple absorption allows formulation in solid form, but is often insufficient for protecting the fragrance during storage. There should also be recourse to a coating of the fragrance/support assembly.

Another formulation method is the use of products of specific molecular structure making it possible to create a cavity for receiving the fragrances, for example products such as cyclodextrins. The drawback, besides the cost, is the difficulty in introducing complex compositions based on products of very different and dissimilar molar mass and steric bulk.

Organic matrices composed of PEG or of paraffins whose molecular mass is sufficient for them to be solid at ordinary temperature, have also been proposed for solidifying fragranced compositions, with advantages but also drawbacks, in particular that of only partially releasing the fragrance, or the fact that molten phases of the coating products need to be used.

Sophisticated methods that are difficult to control, such as the techniques of microencapsulation by interfacial polycondensation, have also been put forward for obtaining encapsulated fragrances, but their cost and their complexity have not facilitated their development.

Finally, the use of preformed microcapsules, either mineral or polymeric, which are optionally mechanically disintegrable, have also been envisaged, without great commercial success, probably for economic reasons.

The Applicant has found a water-dispersible solid formulation for liquid fragrances, by encapsulation with a protective matrix which becomes located outside the droplets of finely divided fragrance; in this way, said matrix coats the fragrance, protects it and at the same time allows it to change to solid form.

A first subject of the invention consists of water-dispersible granules comprising at least one hydrophobic fragrance (P), in the form of droplets, which is finely divided in and encapsulated by a water-soluble or water-dispersible solid organic matrix (MO) chosen from water-soluble or water-dispersible polypeptides (PP) of plant or synthetic origin polyelectrolytes (PE) belonging to the family of weak polyacids or mixtures thereof, and at least one emulsifier (AE) at the droplet/matrix interface.

For good implementation of the invention, said water-dispersible granules comprise from 5% to 90%, preferably from 25% to 70%, of their weight of fragrance (P), from 5% to 90%, preferably from 25% to 70%, of their weight of water-soluble or water-dispersible organic matrix (MO), from 0.02% to 20%, preferably from 0.1% to 10%, of their weight of emulsifier (AE), said percentages being expressed by weight of solids.

Said droplets can have a mean particle size from about 0.1 μm to 10 μm, preferably from about 0.2 μm to 5 μm.

The term "fragrance" means either a fragranced essence or, more generally, a complex composition obtained using many odoriferous products as a mixture and excipient products which ensure its homogeneity.

Said fragrances according to the invention are isotropic and hydrophobic compounds. Their solubility in water at pH 7 does not exceed 10% by weight.

The mixture of odoriferous products can comprise a large number of constituents, chosen so as to obtain the desired fragranced notes for the intended use, public and market. Natural products (for example plant or animal essences obtained by extraction with steam or by alcoholic extraction, which are themselves already mixtures) or synthetic products which may be aliphatic or aromatic ketones, aliphatic or aromatic aldehydes, condensation products of aldehydes and amines, aromatic or aliphatic lactones, aromatic or aliphatic ethers or esters, aliphatic alcohols of varied molecular mass, linear, cyclic or aromatic saturated or unsaturated hydrocarbons, and terpines, which may or may not be polynuclear, are generally found.

The compositions of the most sophisticated fragrances can contain up to a hundred ingredients.

As examples of odoriferous compounds, mention may be made of:

hexylcinnamaldehyde, 2-methyl-3-(para-tert-butyl-phenyl) propionaldehyde 7-acetyl-1,2,3,4,5,6,7,8-octahydro-1,1,6,7-tetramethylnaphthalene benzyl salicylate; 7-acetyl-1,1,3,4,4,6-hexamethyltetralin para-tert-butylcyclohexyl acetate methyl dihydrojasmonate; beta-naphthyl methyl ether methyl beta-naphthyl ketone; 2-methyl-2-(para-isopropylphenyl)propionaldehyde 1,3,4,6,7,8-hexahydro-4,6,6,7,8,8-hexamethylcyclopenta-gamma-2-benzopyran dodecahydro-3a,6,6,9a-tetramethylnaphtho[2,1-b]bifuran; anisaldehyde coumarin; cedrol; vanillin; cyclopentadecanolide tricyclodecenyl acetate; tricyclodecenyl propionate; phenylethyl alcohol terpineol; linalool; linalyl acetate; geraniol; nerol 2-(1,1-dimethylethyl)cyclohexanol acetate; benzyl acetate; terpenes (orange)

eugenol; diethyl phthalate essential oils, resins or resinoids (oil of orange, lemon, patchouli, Peru balm, Oilbanum resinoid, styrax, coriander, lavandin, lavender, etc.).

Other examples of odoriferous compounds are described in H 1468 (United States Statutory Invention Registration).

Among the water-soluble or water-dispersible synthetic polypeptides (PP) which can constitute the matrix, mention may be made of homopolymers and copolymers derived from the polycondensation of amino acids, in particular of aspartic acid and glutamic acid or precursors of said amino diacids, and hydrolysis. These polymers can be not only homopolymers derived from aspartic acid or glutamic acid but also copolymers derived from aspartic acid and glutamic acid in all proportions, or copolymers derived from aspartic acid and/or glutamic acid and from other amino acids. Among the copolymerizable amino acids which may be mentioned are glycine, alanine, leucine, isoleucine, phenylalanine, methionine, histidine, proline, lysine, serine, threonine, cysteine, etc.

Among the polypeptides (PP) of plant origin, mention may be made of water-soluble or water-dispersible proteins of plant origin. They are preferably hydrolyzed; their degree of hydrolysis is preferably less than or equal to 40%, for example from 5% to less than 40%.

Among the proteins of plant origin which may be mentioned as a guide are proteins originating from proteaginous seeds, in particular those of pea, bean, lupin, haricot and lentil; proteins originating from cereal seeds, in particular those of wheat, barley, rye, corn, rice, oat and millet; proteins originating from oleaginous seeds, in particular those of soya, groundnut, sunflower, rape and coconut; proteins originating from leaves, in particular from alfalfa and nettles; and proteins originating from underground reserves of plant organs, in particular those of potato and beetroot.

The protein of plant origin more particularly originates from soya or wheat.

The polyelectrolyte (PE) can be chosen from those derived from the polymerization of monomers which have the general formula $$(R^1)(R^2)C{=}C(R^3)COOH$$

in which formula $R^1$, $R^2$ and $R^3$ are identical or different and represent a hydrogen atom, a hydrocarbon-based radical containing from 1 to 4 carbon atoms, preferably methyl, a —COOH function, a radical —R—COOH, in which R represents a hydrocarbon-based residue containing from 1 to 4 carbon atoms, preferably an alkylene residue containing 1 or 2 carbon atoms, most particularly methylene.

Non-limiting examples which may be mentioned are acrylic acid, methacrylic acid, maleic acid, fumaric acid, itaconic acid and crotonic acid.

Copolymers obtained from monomers corresponding to the above general formula and those obtained using these monomers and other monomers, in particular vinyl derivatives such as vinyl alcohols and copolymerizable amides such as acrylamide or methacrylamide, are also suitable for use. Mention may also be made of the copolymers obtained from alkyl vinyl ether and from maleic acid as well as those obtained from vinylstyrene and maleic acid, which are described in particular in the Kirk-Othmer encyclopedia entitled "Encyclopedia of Chemical Technology"—Volume 18—3rd Edition—Wiley Interscience Publication—1982.

The preferred polyelectrolytes have a low degree of polymerization. The weight-average molecular mass of the polyelectrolytes is more particularly less than 20,000 g/mol. Preferably, it is between 1000 and 5000 g/mol.

The emulsifiers (AE) which may be present are nonionic, ionic or amphoteric emulsifiers.

When said matrix (MO) is made of a polypeptide (PP), said emulsifier (AE) is chosen from ionic and amphoteric emulsifiers. When said matrix (MO) is a polyelectrolyte (PE), said emulsifier (AE) is chosen from nonionic and amphoteric emulsifiers.

Among the nonionic emulsifiers which may be mentioned in particular are polyoxyalkylenated derivatives such as ethoxylated or ethoxy-propoxylated fatty alcohols ethoxylated or ethoxy-propoxylated triglycerides ethoxylated or ethoxy-propoxylated fatty acids ethoxylated or ethoxy-propoxylated sorbitan esters ethoxylated or ethoxy-propoxylated fatty amines ethoxylated or ethoxy-propoxylated di(1-phenylethyl)-phenols ethoxylated or ethoxy-propoxylated tri(1-phenyl-ethyl) phenols ethoxylated or ethoxy-propoxylated alkylphenols.

The number of oxyethylene (OE) and/or oxypropylene (OP) units in these nonionic surfactants usually ranges from 2 to 100 depending on the desired HLB (hydrophilic/lipophilic balance). The number of OE and/or OP units is more particularly between 2 and 50.

The number of OE and/or OP units is preferably between 10 and 50.

The ethoxylated or ethoxy-propoxylated fatty alcohols generally comprise from 6 to 22 carbon atoms, the OE and OP units being excluded from these numbers. These units are preferably ethoxylated units.

The ethoxylated or ethoxy-propoxylated triglycerides can be triglycerides of plant or animal origin (such as lard, tallow, groundnut oil, butter oil, cottonseed oil, flax oil, olive oil, fish oil, palm oil, grapeseed oil, soybean oil, castor oil, rapeseed oil, copra oil or coconut oil and are preferably ethoxylated.

The ethoxylated or ethoxy-propoxylated fatty acids are esters of fatty acids (such as, for example, oleic acid or stearic acid), and are preferably ethoxylated.

The ethoxylated or ethoxy-propoxylated sorbitan esters are cyclized sorbitol esters of fatty acids comprising from 10 to 20 carbon atoms such as lauric acid, stearic acid or oleic acid, and are preferably ethoxylated.

In the present invention, the term "ethoxylated triglyceride" targets not only the products obtained by ethoxylation of a triglyceride with ethylene oxide but also those obtained by transesterification of a triglyceride with a polyethylene glycol.

Similarly, the term "ethoxylated fatty acid" includes not only the products obtained by ethoxylation of a fatty acid with ethylene oxide but also those obtained by transesterification of a fatty acid with a polyethylene glycol.

The ethoxylated or ethoxy-propoxylated fatty amines generally contain from 10 to 22 carbon atoms, the OE and OP units being excluded from these numbers, and are preferably ethoxylated.

The ethoxylated or ethoxy-propoxylated alkyl phenols are generally 1 or 2 linear or branched alkyl groups containing 4 to 12 carbon atoms. Examples which may be mentioned in particular are octyl, nonyl or dodecyl groups.

Examples of nonionic surfactants from the group of ethoxy or ethoxy-propoxylated alkylphenols, ethoxylated di(1-phenylethyl)phenols and ethoxy or ethoxy-propoxylated tri(1-phenylethyl)phenols which may be mentioned in particular are di(1-phenylethyl)phenol ethoxylated with 5 OE units, di(1-phenylethyl)phenol ethoxylated with 10 OE units, tri(1-phenylethyl)phenol ethoxylated with 16 OE units, tri(1-phenylethyl)phenol ethoxylated with 20 OE units, tri(1-phenylethyl)phenol ethoxylated with 25 OE units, tri(1-phenylethyl)phenol ethoxylated with 40 OE units, tri(1-phenylethyl)phenols ethoxy-propoxylated with 25 OE+OP units, nonylphenol ethoxylated with 2 OE units, nonylphenol ethoxylated with 4 OE units, nonylphenol ethoxylated with 6 OE units, nonylphenol ethoxylated with 9 OE units, nonylphenols ethoxy-propoxylated with 25 OE+OP units, nonylphenols ethoxy-propoxylated with 30 OE+OP units, nonylphenols ethoxy-propoxylated with 40 OE+OP units, nonylphenols ethoxy-propoxylated with 55 OE+OP units and nonylphenols ethoxy-propoxylated with 80 OE+OP units.

Among the anionic emulsifiers which may be mentioned are water-soluble salts of alkyl sulfates and of alkyl ether sulfates, alkyl isothionates and alkyl taurates or salts thereof, alkyl carboxylates, alkyl sulfosuccinates or alkyl succinamates, alkyl sarcosinates, alkyl derivatives of protein hydrolyzates, acyl aspartates, and alkyl and/or alkyl ether and/or alkylaryl ether phosphate esters.

The cation is generally an alkali metal or alkaline-earth metal, such as sodium, potassium, lithium or magnesium, or an ammonium group $NR_4^+$ with R, which may be identical or different, representing an alkyl radical substituted or unsubstituted with an oxygen or nitrogen atom.

Among the cationic emulsifiers which may be mentioned are alkyldimethylbenzylammonium halides, alkyldimethylethylammonium halides, etc.

Among the amphoteric surfactants which may be mentioned are alkylbetaines, alkyldimethylbetaines, alkylamidopropylbetaines, alkylamidopropyldimethylbetaines, alkyltrimethylsulfobetaines, imidazoline derivatives such as alkyl amphoacetates, alkyl amphodiacetates, alkyl amphopropionates, alkyl amphodipropionates, alkylsultaines or alkylamidopropylhydroxysultaines, the condensation products of fatty acids and of protein hydrolyzates, amphoteric derivatives of alkylpolyamines such as Amphionic XL® sold by Rhône-Poulenc, Ampholac 7T/X® and Ampholac 7C/X® sold by Berol Nobel, and proteins or protein hydrolyzates.

According to one embodiment variant, up to 50% of the weight of the matrix (MO) can consist of a water-soluble or water-dispersible ose, oside or polyholoside (O).

Among the oses (O) which may be mentioned are aldoses such as glucose, mannose, galactose and ribose, and ketoses such as fructose.

Osides are compounds which result from the condensation, with elimination of water, of ose molecules with each other or of ose molecules with non-carbohydrate molecules. Among the preferred osides are holosides which are formed by combining exclusively carbohydrate units and more particularly oligoholosides (or oligosaccharides) which comprise only a limited number of these units, i.e. a number generally less than or equal to 10. Examples of oligoholosides which may be mentioned are sucrose, lactose, cellobiose, maltose and trehalose.

The water-soluble or water-dispersible polyholosides (or polysaccharides) are highly depolymerized; they are described, for example, in the book by P. Arnaud entitled "Cours de Chimie Organique", edited by Gaultier-Villars, 1987. These polyholosides more particularly have a weight-average molecular mass of less than 20,000 g/mol.

Non-limiting examples of highly polymerized polyholosides which may be mentioned are dextran, starch, xanthan gum and galactomannans such as guar or carob, these polysaccharides preferably having a melting point of greater than 100° C. and a solubility in water of between 50 g/l and 500 g/l.

A second subject of the invention consists of a two-step process for preparing water-dispersible granules, comprising at least one hydrophobic fragrance (P), in the form of droplets, which is finely divided in and encapsulated by a water-soluble or water-dispersible solid organic matrix (MO), chosen from water-soluble or water-dispersible polypeptides (PP) of plant or synthetic origin polyelectrolytes (PE) belonging to the family of weak polyacids or mixtures thereof, and at least one emulsifier (AE) at the droplet/matrix interface, the first step consisting in preparing an emulsion in water comprising at least one hydrophobic fragrance (P), at least one emulsifier (AE) and said water-soluble or water-dispersible organic matrix (MO), the second step consisting in drying said emulsion until a granulate is formed.

The term "hydrophobic" is synonymous with solubility in water at pH 7 not exceeding 10% by weight.

The relative amounts of fragrance (P), of emulsifier (AE) and of water-soluble or water-dispersible organic matrix (MO) used are such that said emulsion, expressed as solids, comprises from 5% to 90%, preferably from 25% to 70%, of their weight of hydrophobic fragrance (P), from 5% to 90%, preferably from 25% to 70%, of their weight of water-soluble or water-dispersible organic matrix (MO), from 0.02% to 20%, preferably from 0.1% to 10%, of their weight of emulsifier (AE), said percentages being expressed by weight of solids.

The amount of solids in the emulsion is generally between 10% and 70% by weight and preferably between 20% and 60% by weight.

Any method for preparing emulsions which is known to those skilled in the art and which is described in "Encyclopedia of Emulsions Technology", volumes 1 to 3 by Paul Becher, published by Marcel Dekker Inc., 1983, can be used.

Thus, the method known as direct in-phase emulsification is suitable for preparing the granules according to the invention. It is briefly recalled that this method consists in preparing a mixture containing water, the emulsifier(s), the water-soluble or water-dispersible matrix (MO) and then in introducing the fragrance in liquid form, with stirring.

The emulsion can also be prepared using colloidal mills such as the Menton Gaulin and Microfluidizer (Microfluidics) mills.

The mean particle size of the emulsion is generally between 0.1 and 10 micrometers and preferably between 0.2 and 5 micrometers.

The emulsification can be carried out at a temperature in the region of ambient temperature, although lower or higher temperatures can be envisaged.

The second step of the preparation process according to the invention consists in drying the emulsion thus formulated in order to obtain granules.

The method used to eliminate water from the emulsion and to obtain granules can be carried out by any means known to those skilled in the art.

For example, lyophilization, which corresponds to a step of freezing followed by a step of sublimation, or alternatively spray-drying, are suitable.

These methods of drying, and more particularly spray-drying, are particularly indicated since they make it possible to store the emulsion in its native form and to obtain granules directly. Water-soluble or water-dispersible proteins of plant origin are particularly suitable for spray-drying, since they are particularly stable.

The spray-drying can be carried out in the usual manner in any known apparatus such as, for example, a spraying tower combining a spraying operation carried out using a nozzle or a turbomixer with a stream of hot gas.

The operating conditions depend on the nature of the matrix, on the heat-sensitivity of the fragrance and on the sprayer used; these conditions are generally such that the temperature of the product assembly during drying does not exceed 150° C., and preferably does not exceed 110° C.

Unexpectedly, the spray-drying in a stream of hot gas takes place without any impairment of the fragrance.

It should be noted that additives such as anticaking agents can be incorporated into the granules at the time of the second drying step. It is recommended to use a filler chosen in particular from calcium carbonate, kaolin, silica, bentonite, etc.

The composite particles obtained can be redispersed in water.

The release of the fragrance during the redispersion operation can be controlled by the choice of organic matrix (MO), by selecting a matrix of gradual or slow solubility.

Another subject of the invention consists of the use of said dispersible granules as fragrancing agents in cosmetic compositions and in particular in detergent compositions for washing laundry (industrial or domestic washing).

According to the invention, said granules can be used in a proportion from about 0.01% to 0.5%, preferably from 0.05% to 0.2%, by weight relative to the detergent composition.

A final subject of the invention consists of cosmetic compositions and in particular of detergent compositions for washing laundry (industrial or domestic washing), comprising said fragrance-based dispersible granules.

According to the invention, the detergent compositions can contain about 0.01% to 0.5%, preferably from 0.05% to 0.2%, of their weight of fragrance-based dispersible granules.

The detergent compositions according to the invention comprise at least one surfactant, in an amount generally from about 5% to 60% by weight, preferably from 8% to 50% by weight.

Among these surfactants, mention may be made of the anionic or nonionic surfactants usually used in the field of detergency for washing laundry. The detergent compositions which form the subject of the invention can also comprise common additives, such as inorganic or organic detergent adjuvants ("builders") in an amount such that the total amount of detergent adjuvant is from about 5% to 80% of the weight of said composition, preferably from 8% to 40% by weight, antisoiling agents, anti-redeposition agents, bleaching agents, fluorescence agents, foam suppressants, softeners, enzymes and other additives.

The examples which follow are given for illustrative purposes.

EXAMPLE 1

Preparation of an Emulsion of Fragrance in an Aqueous Solution of Soya Protein

A mixture of the following composition is prepared:

| | |
|---|---|
| FP940 (soya protein hydrolyzate with a degree of hydrolysis of less than 5%, from Protein Technologies International) | 0.6 part by weight (as dry material) |
| Fragrance | 29.6 parts by weight |
| Deionized water | 69.8 parts by weight |

by adding fragrance to an aqueous 5% by weight solution of FP940.

The solids content is 30.2%.

The mixture is first pre-emulsified using an Ultra-Turrax T25 machine for 1 minute at 9500 rpm.

The actual emulsion is prepared using a microfluidizer (M110T from Microfluidics) under the following conditions: pressure: 600 bar—3 emulsification cycles in the microfluidizer—bath of cold water at the microfluidizer outlet.

The emulsion obtained has a narrow particle size with a median diameter (d50) of 1.3 $\mu$m.

Incorporation of the Soya Protein Matrix

The same plant protein (FP940 from Protein Technologies International) is incorporated into the emulsion prepared, as polypeptide matrix.

The composition of the emulsion formulated is as follows:

| | |
|---|---|
| FP940 (soya protein hydrolyzate with a degree of hydrolysis of less than 5%, from Protein Technologies International) (emulsifier) | 0.47 part by weight (as dry material) |
| Fragrance | 22.95 parts by weight |
| FP940 (soya protein hydrolyzate with a degree of hydrolysis of less than 5%, from Protein Technologies International) (matrix) | 22.48 parts by weight (as dry material) |
| Deionized water | 54.10 parts by weight |

This formulated emulsion has 45.9% solids and a median diameter (d50) of 1.3 $\mu$m.

The composition of this emulsion corresponds to an A/B dry weight ratio of 51/49, in which ratio A and B have the following meaning:

A=(fragrance+emulsifying protein FP940)/total % of solids×100

B=matrix protein FP940/total % of solids×100

Drying of the Formulated Emulsion

This emulsion is then dried by lyophilization. The granules obtained from this treatment have the following composition:

| | |
|---|---|
| FP940 (soya protein hydrolyzate with a degree of hydrolysis of less than 5%, from Protein Technologies International) (emulsifier) | 1 part by weight |
| Fragrance | 50 parts by weight |
| FP940 (soya protein hydrolyzate with a degree of hydrolysis of less than 5%, from Protein Technologies International) (matrix) | 49 parts by weight |

Redispersion of the granules in water again gives an emulsion of fragrance of fairly uniform particle size distribution and has a median diameter (d50) of 2.5 $\mu$m.

EXAMPLE 2

Preparation of an Emulsion of Fragrance in an Ethoxylated Fatty Alcohol

A mixture of the following composition is prepared:

| | |
|---|---|
| 20.0% | fragrance |
| 1.2% | Synperonic All ($C_{13}$–$C_{15}$ ethoxylated fatty alcohol containing on average 11 EO) |
| 78.8% | deionized water |

having a solids content of 21.2%.

The mixture is first pre-emulsified in an Ultra-Turrax T25 machine for 1 minute at 9500 rpm. The actual emulsion is prepared using a microfluidizer (M110T from Microfluidics) under the following conditions: pressure: 500 bar—3 emulsification cycles in the microfluidizer—bath of cold water at the microfluidizer outlet.

The emulsion obtained has a polydisperse particle size with a median diameter (d50) of 0.7 mm.

Incorporation of the Polyacrylic Acid Matrix

The matrix incorporated into the emulsion is a polyacrylic acid with a molar mass of 2000 g/mol, from Bevaloid.

The composition of the formulated emulsion is as follows:

| | |
|---|---|
| 18.6% | fragrance |
| 1.1% | Synperonic All (emulsifier) |
| 4.9% | polyacrylic acid Mw = 2000 g/mol (matrix) |
| 75.4% | deionized water |

Its solids content is 24.6%.

The composition of the emulsion thus formulated corresponds to an A/B solids weight ratio of 80/20 with:

A=fragrance+Synperonic All/total % of solids×100

B=polyacrylic acid/total % of solids×100

Drying of the Emulsion Formulated

This formulation is then dried by lyophilization. The granules obtained from this treatment have the following composition:

| | |
|---|---|
| 75.6% | fragrance |
| 4.5% | Synperonic All (emulsifier or dispersant) |
| 19.9% | polyacrylic acid (matrix) |

Redispersion of the granules in water again gives an emulsion of fragrance of polydisperse particle size distribution with a median diameter (d50) of 1.5 mm.

According to the storage conditions, it may be necessary to add a silica in the following proportions:

| | |
|---|---|
| 66.70% | fragrance |
| 4.00% | Synperonic All (emulsifier or dispersant) |
| 17.55% | polyacrylic acid (matrix) |
| 11.75% | Tixosil T38A silica (Rhone-Poulenc) |

What is claimed is:

1. Water-dispersible granules comprising at least one hydrophobic fragrance (P), in the form of droplets, which is finely divided in and encapsulated by a water-soluble or water-dispersible solid organic matrix (MO) which is a water-soluble or water-dispersible polypeptides (PP) of plant origin, and at least one emulsifier (AE) at the droplet/matrix interface, made by the process of:

a) preparing an emulsion in water comprising at least one hydrophobic fragrance (P), at least one emulsifier (AE) and said water-soluble or water-dispersible organic matrix (MO), and b) drying said emulsion by lyophilization or spray-drying to obtain the granules.

2. Granules according to claim 1, comprising:

from 5% to 90%, of their weight of fragrance (P), from 5% to 90%, of their weight of water-soluble or water-dispersible organic matrix (MO), and from 0.02% to 20%, of their weight of emulsifier (AE), said percentages being expressed by weight of solids.

3. Granules according to claim 2, comprising:

from 25% to 70%, of their weight of fragrance (P), from 25% to 70%, of their weight of water-soluble or water-dispersible organic matrix (MO), and from 0.1% to 10%, of their weight of emulsifier (AE).

4. Granules according to claim 1, wherein the droplets have a mean particle size from 0.1 $\mu$m to 10 $\mu$m.

5. Granules according to claim 4, wherein the droplets have a mean particle size from 0.2 $\mu$m to 5 $\mu$m.

6. Granules according to claim 1, wherein the fragrance (P) comprises natural or synthetic odoriferous products based on aliphatic or aromatic ketones, aliphatic or aromatic aldehydes, condensation products of aldehydes and amines, aromatic or aliphatic lactones, aromatic or aliphatic ethers or esters, aliphatic alcohols, linear, cyclic or aromatic saturated or unsaturated hydrocarbons, and terpenes, said products being optionally polynuclear.

7. Granules according to claim 1, wherein the plant origin is soya or wheat, hydrolyzed with a degree of hydrolysis of less than or equal to 40%.

8. Granules according to claim 1, wherein the emulsifier (AE) is nonionic, anionic, cationic or amphoteric.

9. Granules according to claim 8, wherein the emulsifier (AE) is nonionic and is a polyoxyalkylenated surfactant.

10. Granules according to claim 1, wherein the emulsifier (AE) is amphoteric and is a protein, or a protein hydrolyzate.

11. Granules according to claim 1, wherein the polypeptide (PP) of plant origin is a soya protein.

12. A cosmetic or detergent composition for washing laundry, comprising granules as defined in claim 1, as fragrancing agents.

13. A cosmetic or detergent composition according to claim 12, wherein the granules are present in a proportion from about 0.01% to 0.5%, relative to said detergent compositions.

14. A cosmetic or detergent composition according to claim 13, wherein the granules are present in a proportion from 0.05% to 0.2%, relative to said detergent compositions.

15. A process for the preparation of water-dispersible granules comprising at least one hydrophobic fragrance (P), in the form of droplets, which is finely divided in and encapsulated by a water-soluble or water-dispersible solid organic matrix (MO) which is a water-soluble or water-dispersible polypeptides (PP) of plant origin, and at least one emulsifier (AE) at the droplet/matrix interface, said process comprising the steps of:

a) preparing an emulsion in water comprising at least one hydrophobic fragrance (P), at least one emulsifier (AB) and said water-soluble or water-dispersible organic matrix (MO), and b) drying said emulsion by lyophilization or spray-drying to obtain the granules.

16. A process according to claim 15, wherein the relative amounts of fragrance (P), of emulsifier (AE) and of water-soluble or water-dispersible organic matrix (MO) used are such that said emulsion, expressed as solids, comprises from 5% to 90%, of their weight of hydrophobic fragrance (P), from 5% to 90%, of their weight of water-soluble or water-dispersible organic matrix (MO), and from 0.02% to 20% of their weight of emulsifier (AE), said percentages being expressed by weight of solids.

17. A process according to claim 16, wherein the amount of solids in the emulsion is between 10% and 70% by weight.

18. A process according to claim 16, wherein the mean particle size of the emulsion is between 0.1 and 10 micrometers.

19. A process according to claim 18, wherein the mean particle size of the emulsion is between 0.2 and 5 micrometers.

20. A process according to claim 16, wherein in step b), anticaking agents are further added.

* * * * *